US008511238B2

(12) United States Patent
Kikko et al.

(10) Patent No.: US 8,511,238 B2
(45) Date of Patent: Aug. 20, 2013

(54) STEERABLE TRUCK FOR A RAILWAY CAR, A RAILWAY CAR, AND AN ARTICULATED CAR

(75) Inventors: Satoshi Kikko, Amagasaki (JP); Takuji Nakai, Kishiwada (JP); Yujin Tsutsui, Osaka (JP)

(73) Assignee: Nippon Steel & Sumitomo Metal Corporation, Tokyo (JP)

( * ) Notice: Subject to any disclaimer, the term of this patent is extended or adjusted under 35 U.S.C. 154(b) by 0 days.

(21) Appl. No.: 12/727,604

(22) Filed: Mar. 19, 2010

(65) Prior Publication Data

US 2010/0229753 A1 Sep. 16, 2010

Related U.S. Application Data

(63) Continuation of application No. PCT/JP2008/066719, filed on Sep. 17, 2008.

(30) Foreign Application Priority Data

Sep. 21, 2007 (JP) ..... 2007-245494
Oct. 11, 2007 (JP) ..... 2007-265734

(51) Int. Cl.
*B61D 1/00* (2006.01)
*B61D 15/00* (2006.01)

(52) U.S. Cl.
USPC ..... 105/157.1; 105/171

(58) Field of Classification Search
USPC ..... 105/157.1, 158.1, 171, 175.1, 176, 105/194
See application file for complete search history.

(56) References Cited

U.S. PATENT DOCUMENTS 3,993,326 A * 11/1976 Schmidt ..... 280/426
4,802,418 A * 2/1989 Okamoto et al. ..... 105/167
5,555,816 A * 9/1996 Jones ..... 105/168

(Continued)

FOREIGN PATENT DOCUMENTS

JP 49-32816 9/1974
JP 6-87446 3/1994

(Continued)

OTHER PUBLICATIONS

A. Matsumoto, et al., "The Influence of Bogie and Track Dynamical Behaviours on the Formation of Rail Corrugation (2nd Report)", J-Rail '95, pp. 149-152.

(Continued)

*Primary Examiner* — R. J. McCarry, Jr.
(74) *Attorney, Agent, or Firm* — Clark & Brody

(57) ABSTRACT

A steerable truck for a railway car is provided with a truck frame that is steered so as to be aligned with the tangential direction of a curved track by controlling only the steering angle of a rear wheelset. During travel along a curved track, the steering angle, which is the angle in a horizontal plane of the centerline of the rear wheelset with respect to an imaginary straight line connecting the center of the truck frame and the center of the curved track, is larger than the steering angle which is the angle formed between the imaginary straight line and the centerline of the front wheelset. As a result, a steerable truck for a railway car which has excellent ability to travel along a curve and which can be actually realized simply and at a low cost is provided.

12 Claims, 16 Drawing Sheets

(56) References Cited

U.S. PATENT DOCUMENTS

| | | | | |
|---|---|---|---|---|
| 5,603,265 | A * | 2/1997 | Jones | 105/167 |
| 5,921,185 | A * | 7/1999 | Hoyon et al. | 105/4.1 |
| 6,006,674 | A * | 12/1999 | Ahmadian et al. | 105/220 |
| 2005/0103223 | A1 * | 5/2005 | Schneider et al. | 105/168 |

FOREIGN PATENT DOCUMENTS

| | | |
|---|---|---|
| JP | 9-109886 | 4/1997 |
| JP | 2000-272514 | 10/2000 |
| JP | 2002-87262 | 3/2002 |
| JP | 2003-27660 | 10/2003 |
| WO | 91/09765 | 7/1991 |

OTHER PUBLICATIONS

Y. Sato et al., "Attack Angle and Lateral Displacement between Wheel and Rail by Wayside Measurement", Proceedings of the 73rd Regular General Meeting of the Japan Society of Mechanical Engineers, 1996, pp. 352-353.

* cited by examiner (a)

(b)

(a)

(b)

(a)

(b)

(a)

(b)

(a)

(b)

(a)

(b)

STEERABLE TRUCK FOR A RAILWAY CAR, A RAILWAY CAR, AND AN ARTICULATED CAR

This application is a continuation of International Patent Application No. PCT/JP2008/066719, filed Sep. 17, 2008. This PCT application was not in English as published under PCT Article 21(2).

TECHNICAL FIELD

This invention relates to a steerable truck for a railway car and a railway car and an articulated car equipped with this steerable truck.

BACKGROUND ART

Improving the ability of a railway car to smoothly travel along a curved track is and has been an important technical problem. There is a strong desire for an increased ability of a railway car to travel along curves, particularly for railway cars traveling along sharp curves in suburban railways such as underground railways.

FIG. 14 is an explanatory view schematically showing the behavior of a conventional truck 3 in which the wheels are not steered with respect to a truck frame 2 when traveling along a curved track 4. The truck frame 2 which is traveling along a curved track 4, the wheelset 1*f* positioned to the front in the direction of travel (referred to in this description as the front wheelset) and the wheelset 1*r* positioned to the rear in the direction of travel (referred to in this description as the rear wheelset) assume the attitudes shown in FIG. 14. Symbol O in FIG. 14 indicates the center of the arc defined by the curved track 4.

Non-Patent Document 1 discloses that (a) the flange of the wheel 5 on the outer side of the front wheelset 1*f* contacts the rail 4*a* on the outer side and an attack angle θ develops; (b) this attack angle θ causes a lateral pressure Qsi to be applied by the inner track; and (c) the rear wheelset 1*r* is located approximately midway between the left and right rails 4*a* and 4*b*, so in the rear wheelset 1*r*, an attack angle θ does not develop to the same extent as in the front wheelset 1*f*. However, since a sufficient difference between the rolling radius of the left and right wheels 5 is not obtained, the radius difference in the rear wheelset is insufficient and causes a longitudinal creep force Fvc to develop. The inner track lateral pressure Qsi and the longitudinal creep force Fvc produce a yawing moment My in the counterclockwise direction about the center of gravity of the truck frame 2. In FIG. 14, Qso indicates the outer track lateral pressure which develops in the front wheelset 1*f*.

Non-Patent Document 2 discloses that the truck frame 2 also has a yawing angle ϕ which is defined as the angle in a horizontal plane of the truck frame to the left and right with respect to the radial direction of the curved track. The yawing angle ϕ of the truck frame 2 has the same rotational direction as the attack angle θ of the front wheelset 1*f*. The yawing angle ϕ of the truck frame 2 causes the attack angle θ of the front wheelset 1*f* which is supported by this truck frame 2 to further increase.

Patent Document 1 discloses an invention in which in order to increase the ability of a railway car to travel along a curved track, an actuator is used as a supplemental means so that the truck frames which are positioned to the front and rear in the direction of travel pivot in synchrony with respect to the car body in the self-steering direction. That invention can decrease the yawing angle of the truck frame during travel along a curved track.

However, in order to carry out the invention disclosed in Patent Document 1, it is necessary to provide not only an actuator but also a controller for the actuator. In addition, it is necessary to provide safety measures for the event in which control of the actuator cannot be carried out in a normal manner. Therefore, the apparatus becomes complicated and costly.

A link-type steerable truck which uses links without using an actuator is also being developed. FIG. 15 is an explanatory view schematically showing the structure of a typical link-type steerable truck 11. FIG. 15(*a*) is a plan view and FIG. 15(*b*) is a side view thereof.

In this steerable truck 11, the front wheelset 1*f* and the rear wheelset 1*r* are connected to a bolster 12, which is mounted on an unillustrated car body, and to a truck frame 13 by pairs of first links 14*a* and 14*b*. Of the first links 14*a* and 14*b*, each of the first links 14*b* which is connected to the truck frame 13 (referred to below as steering levers 14*b*) is connected to an axle box 19 which rotatably supports the front wheelset 1*f* or the rear wheelset 1*r* by a second link 15.

In this steerable truck 11, displacement of the bolster 12 on the car body side with respect to the truck 11 by the bogie angle is transmitted to the steering levers 14*b* throng the first links 14*a*. In the example shown in FIG. 15, the connection points between the first links 14*a* and the steering levers 14*b* are connection points 16 on the car body side.

The transmitted displacement adjusts the steering amount based on the lever ratio when the connection points between the steering levers 14*b* and the truck frame 13, i.e., the connection points 17 on the truck frame side act as centers of pivoting (fulcrums), and the front wheelset 1*f* and the rear wheelset 1*r* are steered through the connection points between the steering levers 14*b* and the second links 15, namely, through the connection points 18 on the wheelset side.

FIG. 16 is an explanatory view showing the behavior of the steerable truck 11 when traveling along a curved track.

As shown in FIG. 16, in this steerable truck 11, the steering angle α1, which is the angle between the centerline CL1 of the front wheelset 1*f* and an imaginary straight line CL3 in a horizontal plane connecting the center of the truck frame 13 with the center of a circular arc defined by the curved track, is the same as the steering angle α2 formed between the centerline CL2 of the rear wheelset 1*r* and the straight line CL3.

Non-Patent Document 1: "Properties of Trucks and Tracks During Travel Along a Sharp Curve and their Effect on Rail Corrugation", J-Rail '95

Non-Patent Document 2: "Methods of Measuring the Attack Angle of Wheels and the Relative Displacement of Wheels and Rails by Measurement on the Ground", Proceedings of the 73rd Regular General Meeting of the Japan Society of Mechanical Engineers Patent Document 1: JP 2002-87262 A1

DISCLOSURE OF INVENTION

Problem Which the Invention is to Solve

With the steerable truck 11 shown in FIGS. 15 and 16, in order to increase the ability to travel along a curve, it is necessary for the truck frame 13 to movably support the axle boxes 19 for the front wheelset 1*f* and the rear wheelset 1*r* so that the front wheelset 1*f* and the rear wheelset 1*r* both have prescribed steering angles α1 and α2.

Therefore, in this steerable truck 11, there is a limit to the degree of increase in the stiffness with which the truck frame 13 supports the front wheelset 1*f* and the rear wheelset 1*r*, and it is not easy to simultaneously provide all of the properties demanded of a truck for a railway car including the ability to stably travel along a straight track and prescribed vibration properties.

The present invention was made in light of such problems of the prior art, and it provides a steerable truck for a railway car which can be simply carried out at a low cost and which has excellent ability to travel along a curved track without worsening properties such as the ability to travel along a straight track and vibration properties. It also provides a railway car and articulated cars equipped with this steerable truck.

Means for Solving the Problem

The steering angle of the front wheelset and the steering angle of the rear wheelset in the steerable truck disclosed in Patent Document 1 and the like and in the steerable truck explained while referring to FIGS. 15 and 16 are set to the same value based on the premise that a railway car which can reverse the direction of travel should be symmetric in the fore and aft direction.

The present invention is contrary to such technical common sense, and it is based on the original technical concept: "When traveling along a curved track, of the steering angles of the wheelsets which are defined as the angles between an imaginary straight line connecting the center of the truck frame and the center of a circular arc defined by the curved track in a horizontal plane (referred to below as the reference line) and the centerlines of the front and rear wheelsets, by controlling the steering angle of the rear wheelset and preferably by controlling the steering angle only of the rear wheelset such that the steering angle which is the angle between the reference line and the centerline of the rear wheelset becomes larger than the steering angle which is the angle between the reference line and the centerline of the front wheelset, steering is performed such that the truck frame is aligned with the tangential direction of the curved track. Namely, the yawing angle of the truck frame which is the angle in a horizontal plane of the centerline in the fore and aft direction of the truck frame with respect to the radial direction of the curved track can be decreased. As a result, a steerable truck for a railway car which has excellent ability to travel along a curved track and which can be carried out simply and at a low cost and without a worsening of properties such as the ability to travel along a straight track and vibration properties can be provided".

The present invention is a steerable truck for a railway car having a truck frame which rotatably supports a front wheelset positioned on the front side in the direction of travel and a rear wheelset positioned on the rear side in the direction of travel through axle boxes, and a truck frame steering unit for controlling the steering angle of at least the rear wheelset when traveling along a curved track, characterized in that when the truck is traveling along a curved track, the truck frame is steered so as to be aligned with the tangential direction of the curved track by controlling the steering angle of the rear wheelset by the truck frame steering unit so that the steering angle of the rear wheelset is larger than the steering angle of the front wheelset.

Also the present invention is a steerable truck for a railway car having a truck frame which rotatably supports a front wheelset positioned on the front side in the direction of travel and a rear wheelset positioned on the rear side in the direction of travel through axle boxes, and a truck frame steering unit for controlling the steering angle of at least the rear wheelset when traveling along a curved track, characterized in that when the truck is traveling along a curved track, the yawing angle of the truck frame, which is the angle formed in a horizontal plane between the radial direction of the curved track and the centerline in the fore and aft direction of the truck frame, is decreased by controlling the steering angle of the rear wheelset by the truck frame steering unit so that the steering angle of the rear wheelset is larger than the steering angle of the front wheelset.

In the present invention, the truck frame steering unit preferably controls only the steering angle of the rear wheelset during travel along a curved track.

In the present invention, control of the steering angle of the rear wheelset by the truck frame steering unit is preferably carried out by a link mechanism mounted on the truck frame. Furthermore, the link mechanism preferably controls the steering angle in accordance with the bogie angle which is the relative displacement of the truck frame with respect to the car body when traveling along a curved track.

In the present invention, the link mechanism preferably has a first link which connects the car body and the truck frame, and a second link which connects the first link and at least an axle box which rotatably supports the rear wheelset.

In the present invention, the stiffness of the links connected to the rear wheelset is preferably different from the stiffness of the links connected to the front wheelset.

From another standpoint, the present invention is a railway car having a truck on the front side and a truck on the rear side in the direction of travel, characterized in that at least one of the trucks on the front side and the rear side in the direction of travel is the above-described steerable truck for a railway car according to the present invention.

The present invention is also a railway car characterized by having the above-described steerable truck for a railway car according to the present invention on the front side and on the rear side in the direction of travel, with the steerable trucks for a railway car being provided so that the rear wheelset is positioned on the inner side in the direction of travel.

In addition, the present invention is articulated cars characterized by having the above-described steerable truck for a railway car according to the present invention at least in the articulated portion between two car bodies.

Effects of the Invention

According to the present invention, a steerable truck for a railway car which has excellent ability to travel on a curved track and which can actually be realized because it can be carried out simply and at low cost, and a railway car and articulated cars having this steerable truck can be provided

Explanation of Symbols

| | | | |
|---|---|---|---|
| 1f | front wheelset; | 1r | rear wheelset |
| 12 | bolster; | 13 | truck frame |
| 14a | first link; | 14b | first link (steering lever) |
| 15 | second link | | |
| 16 | connection point on car body side | | |
| 17 | connection point on truck frame side | | |
| 18 | connection point on wheelset side | | |
| 21 | steerable truck; | 31 | railway car |

BEST MODE FOR CARRYING OUT THE INVENTION

Below, the best mode for carrying out the present invention will be explained while referring to the attached drawings.

Figure 14:
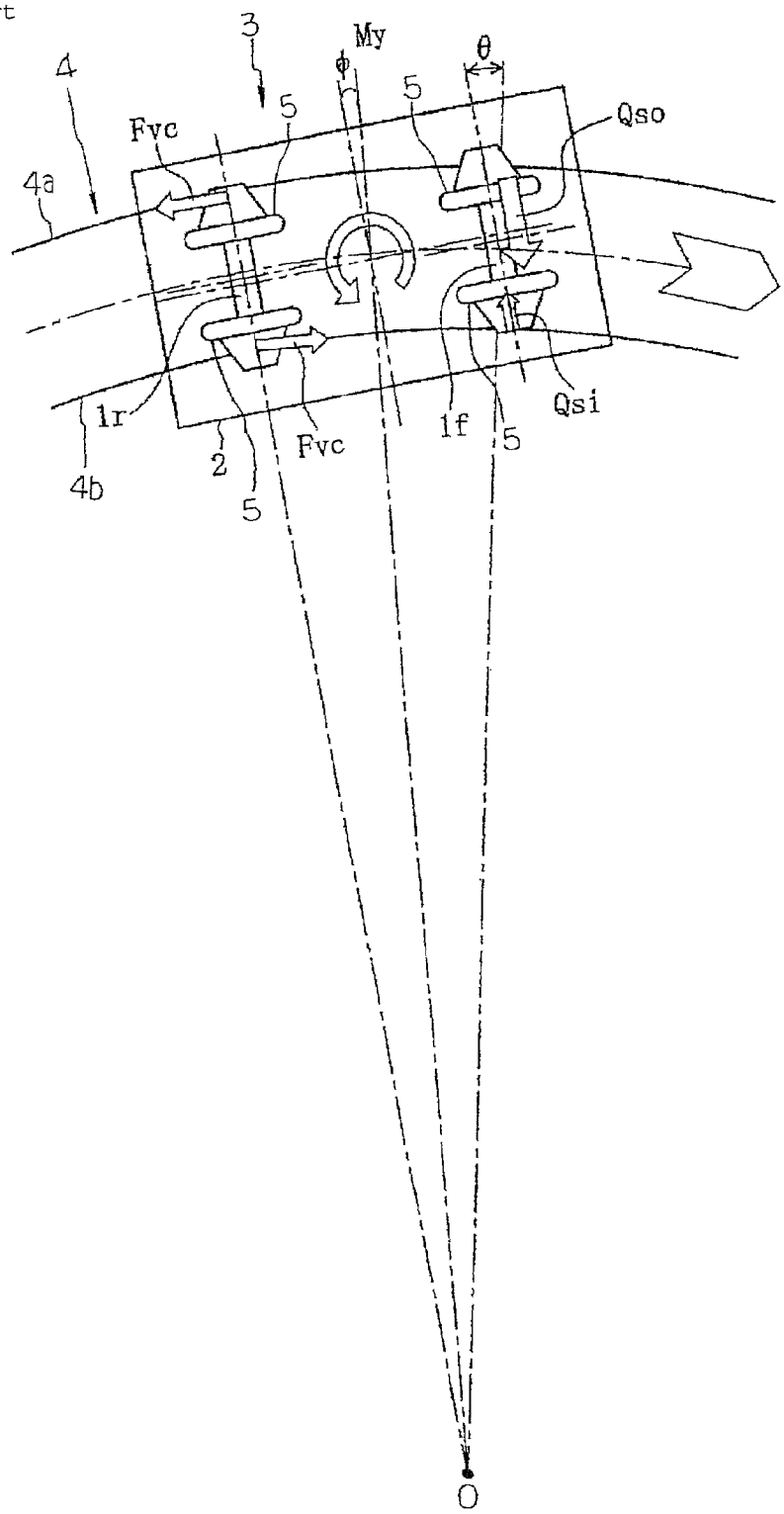
Fig. 14 Prior Art
FIG. 14 is a view showing the behavior of a conventional truck when traveling along a curved track.
Figure 15:
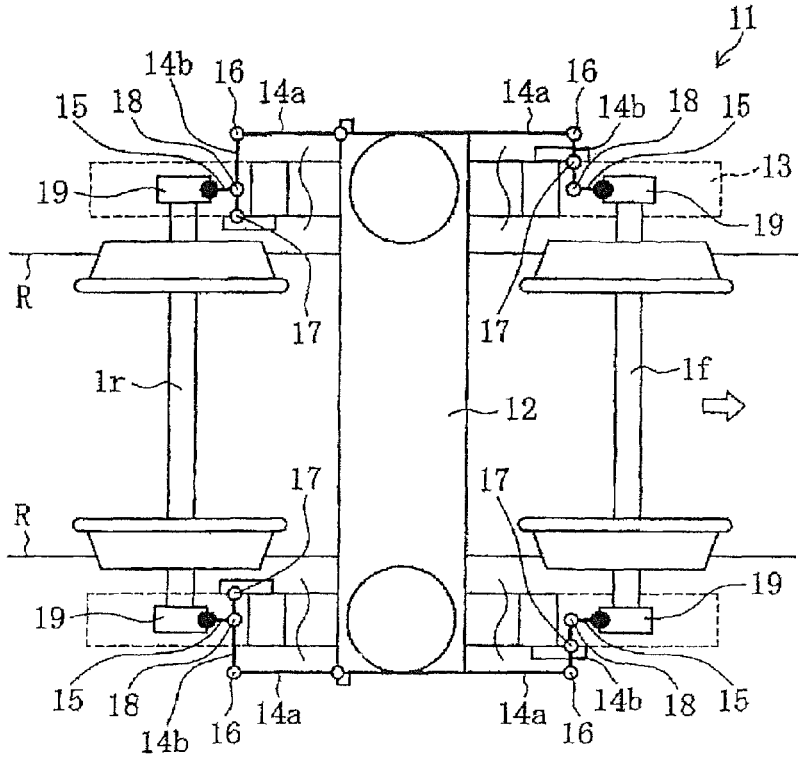
Fig. 15 Prior Art
FIG. 15 is an explanatory view schematically showing the structure of a typical link-type steerable truck, FIG. 15(*a*) being a plan view and FIG. 15(*b*) being a side view.
Figure 15:
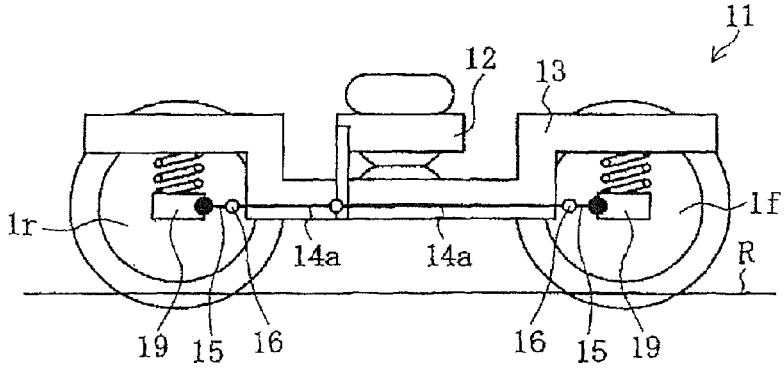
Fig. 15 Prior Art
Figure 16:
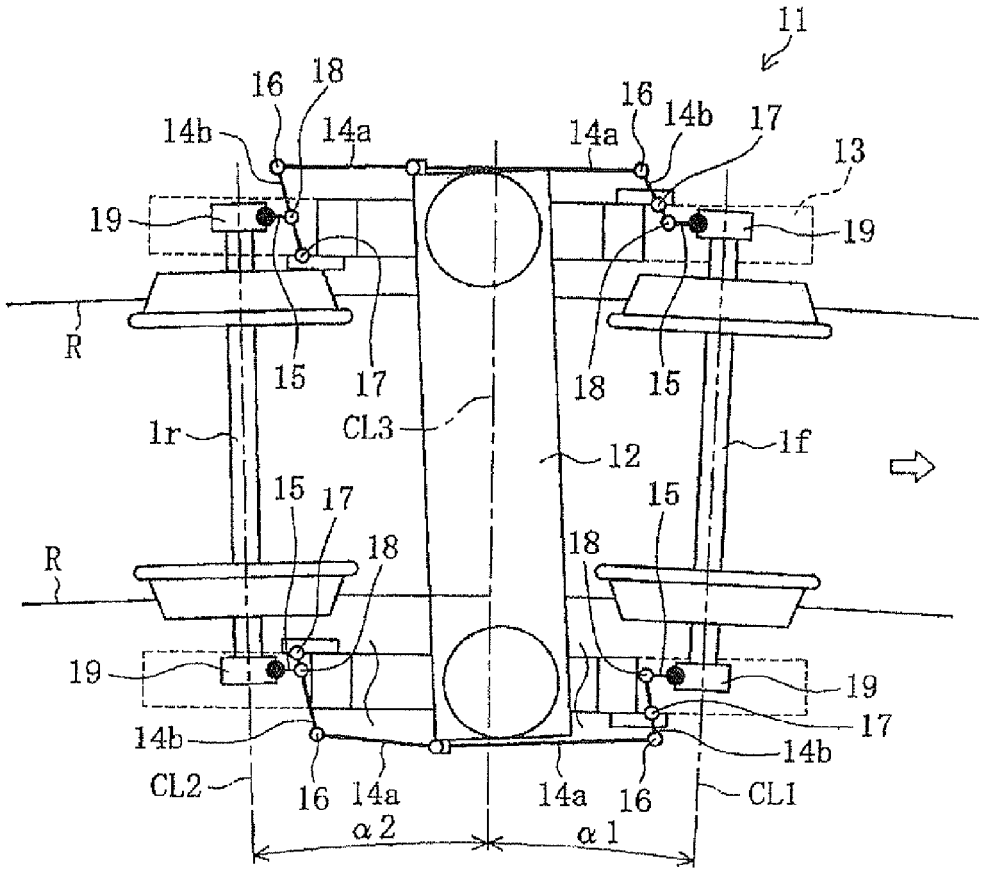
FIG. 16 is an explanatory view showing the behavior of the steerable truck shown in FIG. 15 when traveling along a curved track.
Figure 16:
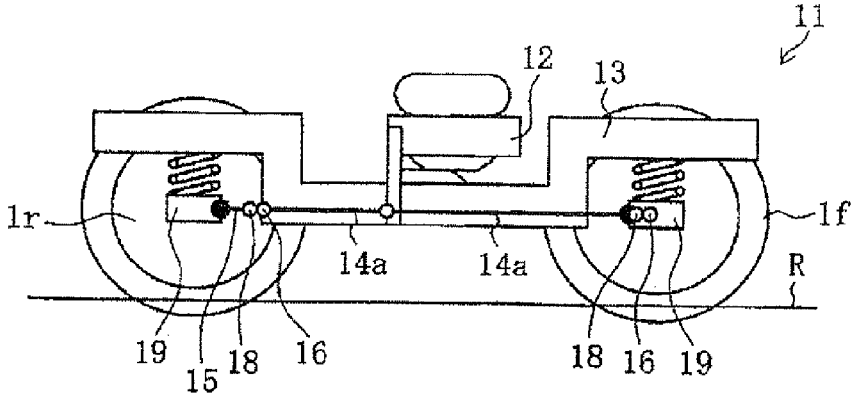

In the following explanation, an example will be given of the case in which control of the steering angle of the rear wheelset by a truck frame steering unit according to the present invention is carried out by a link mechanism mounted on the truck frame. In addition, in the following explanation, the same components as the components in above-described FIGS. 14-16 are affixed with the same symbols, so a repeated explanation thereof will be omitted.

Figure 1:
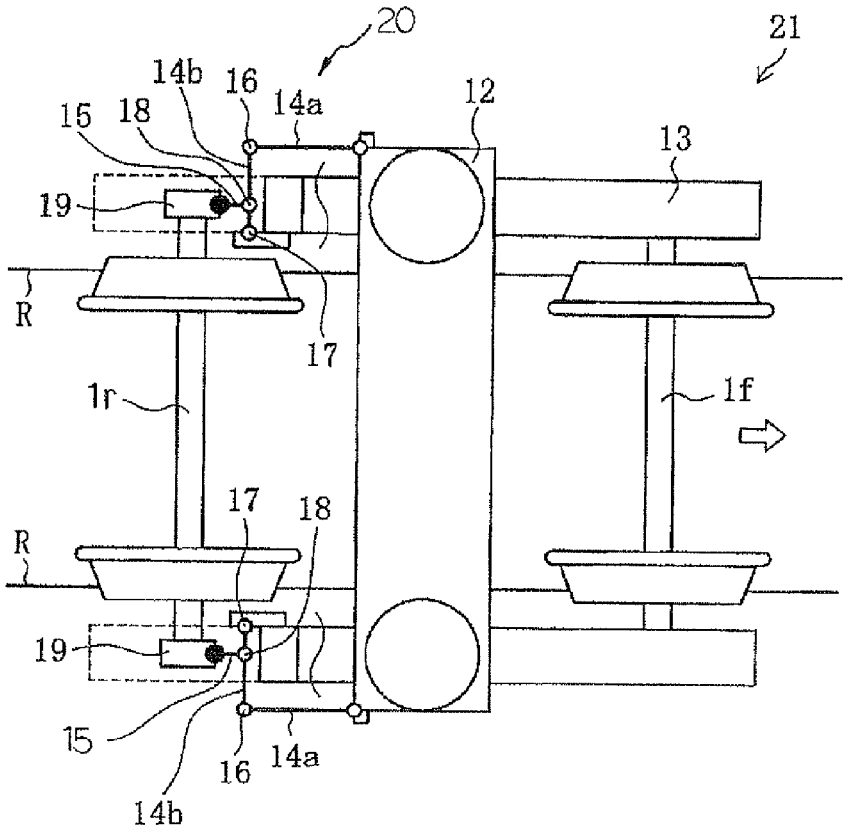
FIG. 1 is an explanatory view schematically showing the structure of a first example of a steerable truck according to the present invention (an example in which only the rear wheelset is controlled), FIG. 1(*a*) being a plan view and FIG. 1(*b*) being a side view.
Figure 1:
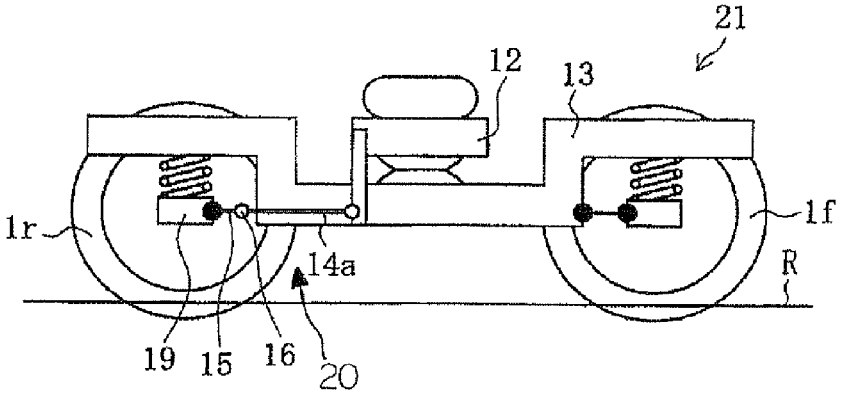

FIG. 1 is an explanatory view schematically showing the structure of a first example of a steerable truck 21 according to the present invention, FIG. 1(*a*) being a plan view and FIG. 1(*b*) being a side view.

This steerable truck 21 has a truck frame steering unit 20 mounted only on the rear wheelset 1*r*.

The rear wheelset 1*r* in this steerable truck 21 is connected to a bolster 12 which is mounted on an unillustrated car body and to a truck frame 13 by pairs of first links 14*a* and 14*b*. Of the first links 14*a* and 14*b*, each first link 14*b* which is connected to the truck frame 13 (referred to below as the steering lever 14*b*) is connected by a second link 15 to an axle box 19 which rotatably supports the rear wheelset 1*r*.

In this steerable truck 21, displacement of the bolster 12 on the car body side with respect to the truck 21 by the bogie angle is transmitted from first links 14*a* to the steering levers 14*b*. In the example shown in FIG. 1, first links 14*a* are connected to the steering levers 14*b* at connection points 16 on the car body side.

The transmitted displacement adjusts the steering amount in accordance with the lever ratio when the connection points between the steering levers 14*b* and the truck frame 13, namely, connection points 17 on the truck frame side act as centers of pivoting (fulcrums), and the rear wheelset 1*r* is steered through the connection points between steering levers 14*b* and the second links 15, namely, through connection points 18 on the wheelset side.

Figure 2:
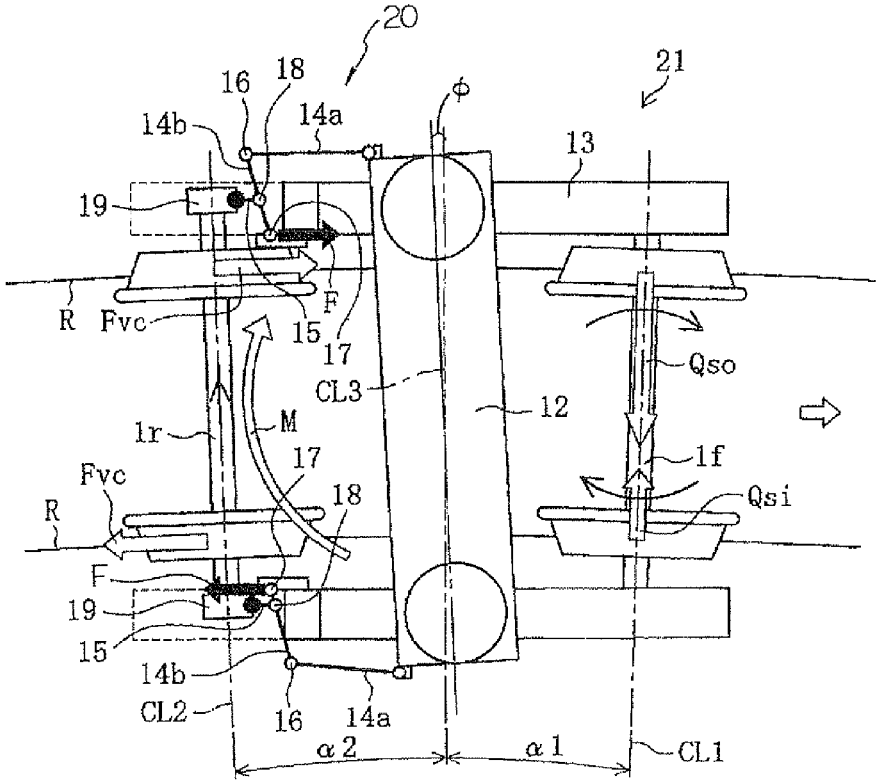
FIG. 2 is an explanatory view illustrating the behavior of the steerable truck according to the present invention shown in FIG. 1 when traveling along a curved track.
Figure 2:
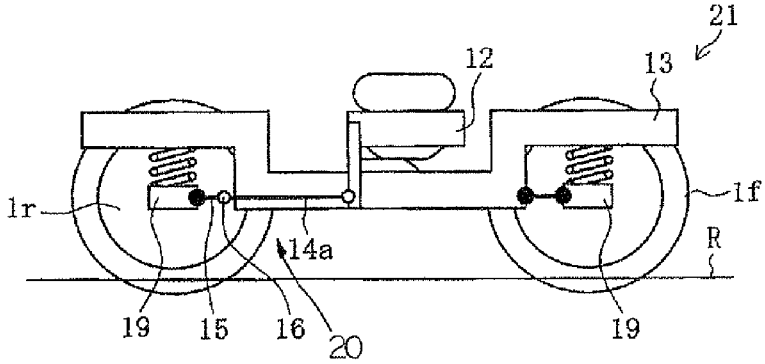

FIG. 2 is an explanatory view showing the behavior of this steerable truck 21 when traveling along a curved track.

With this steerable truck 21, only the rear wheelset 1*r* is steered by the truck frame steering unit 20, so the relationship between the steering angle $\alpha 1$ of the front wheelset 1*f* and the steering angle $\alpha 2$ of the rear wheelset 1*r* becomes $\alpha 2 > \alpha 1$.

The rear wheelset 1*r* which is steered by the truck frame steering unit 20 is moved towards the outer rails as shown by the arrow in FIG. 2 by the self-steering function (the function in which the wheelset shifts in the axial direction so that a suitable rolling radius difference is obtained). Due to this movement, a rolling radius difference is obtained between both wheels of the rear wheelset 1*r*. As the rolling radius difference increases, the longitudinal creep forces Fvc end up being in the directions shown in FIG. 2, which are opposite to the directions of the forces for the conventional truck 3 shown in FIG. 14.

In a steerable truck 21 in which the bolster 12 on the car body side, the truck frame 13, and the rear wheelset 1*r* are connected by pins or the like, the longitudinal creep forces Fvc which act on the rear wheelset 1*r* are transmitted by the steering levers 14*b* from the rear wheelset 1*r* to the axle boxes 19 with the connection points 16 on the car body side acting as fulcrums and with the connection points 18 on the wheelset side acting as points of effort, and it is transmitted to the truck frame 13 via the connection points 17 on the truck frame side as acting forces F.

Therefore, in the steerable truck 21, as described above, the longitudinal creep forces Fvc is applied to the truck frame 13 as acting forces F in the opposite directions from a conventional truck 3.

With the conventional truck 3 shown in FIG. 14, the longitudinal creep forces Fvc produce a yawing moment My (referred to below as an antisteering moment, abbreviated as ASM) which imparts a yawing angle $\phi$ to the truck frame 13. In contrast, with this steerable truck 21, the above-described forces F produce a moment M (steering moment, abbreviated as SM) which decreases the yawing angle.

In this steerable truck 21, due to the truck frame 13 rotating in the clockwise direction as shown in FIG. 2, the outer track lateral force Qso, the inner track lateral force Qsi, and the attack angle $\theta$ of the front wheelset 1*f* are all decreased.

Next, the difference between a typical link-type steerable truck and a truck according to the present invention will be explained. In the typical link-type steerable truck 11 shown in FIG. 15, the steering angle of the front wheelset 1*f* and the steering angle of the rear wheelset 1*r* are the same. In contrast, in the steerable truck 21 according to the present invention shown in FIG. 1, the steering angle of the rear wheelset 1*r* is larger than the steering angle of the front wheelset 1*f*. The difference between a typical steerable truck 11 and a steerable truck 21 according to the present invention is a difference in the function of the steering levers 14*b*. This relationship is summarized in Table 1. In Table 1, pattern 1 corresponds to the typical link-type steerable truck 11 shown in FIG. 15, and pattern 2 corresponds to the steerable truck 21 according to the present invention shown in FIG. 1. The typical steerable truck 11 shown in FIG. 15 uses the connection points 16 with the bolster as points of effort, it uses the connection points 17 with the truck frame as fulcrums, and it uses the connection points 18 with the axle boxes as points of load, whereby both the front and rear wheelsets are steered. In contrast, in the steerable truck 21 of the present invention shown in FIG. 1, the connection points 18 with the axle boxes are used as points f effort, the connection points 16 with the bolster are used as fulcrums, and the connection points 17 with the truck frames are used as points of load, and the truck frame is steered.

TABLE 1

| | Connection point 16 | Connection point 17 | Connection point 18 | Steering location |
|---|---|---|---|---|
| Pattern 1 | Point of effort | Fulcrum | Point of load | Wheelset steering |
| Pattern 2 | Fulcrum | Point of load | Point of effort | Truck frame steering |

By comparing FIG. 16 and FIG. 2, it can be seen that by making the steering angle of the rear wheelset 1*r* larger than the steering angle of the front wheelset 1*f*, steering can be performed so that the truck frame 13 is aligned with the tangential direction of the curved track 4. As a result, the outer track lateral force Qso acting on the front wheelset 1*f* and the attack angle $\theta$ can be decreased.

The present invention was accomplished based on the above-described new knowledge.

Namely, as shown in FIGS. 1 and 2, when a steerable truck 21 for a railway car according to the present invention is traveling along a curved track, by controlling the steering angle of the rear wheelset 1*r* and preferably the steering angle only of the rear wheelset 1*r* so that the steering angle $\alpha 2$ which is the angle formed in a horizontal plane between the centerline CL2 of the rear wheelset 1*r* with respect to the reference line CL3 which is an imaginary straight line connecting the center of the truck frame 13 and the center of the circular arc defined by the curved track is made larger than the steering angle $\alpha 1$ which is the angle of the centerline CL1 of the front wheelset 1*f* with respect to the reference line CL3, the truck frame 13 is steered so as to be aligned with the tangential direction of the curved track. Namely, the yawing angle $\phi$ of the truck frame which is the angle in a horizontal plane of the centerline of the truck frame in the fore and aft direction with respect to the radial direction of the curved track can be decreased.

As an example of the structure of a truck frame steering unit 20 which makes the truck frame 13 steerable, as shown in FIG. 1, for example, the bolster 12 on the car body side and the truck frame 13 can be connected by the first links 14*a* and 14*b*, and first links 14*b* and the rear wheelset 1*r* can be connected by the second links 15.

This link-type truck frame steering unit 20 makes actuators such as are used in Patent Document 1 unnecessary, so not only does a controller for an actuator become unnecessary, but safety measures for the case in which control of the actuator cannot be carried out in the normal manner also become unnecessary.

In a steerable truck 21 for a railway car according to the present invention, a truck frame steering unit 20 which makes the steering angle $\alpha 2$ of the rear wheelset 1*r* larger than the steering angle $\alpha 1$ of the front wheelset 1*f* is not limited to the one shown in FIG. 1 which steers only the rear wheelset 1*r*.

Figure 3:
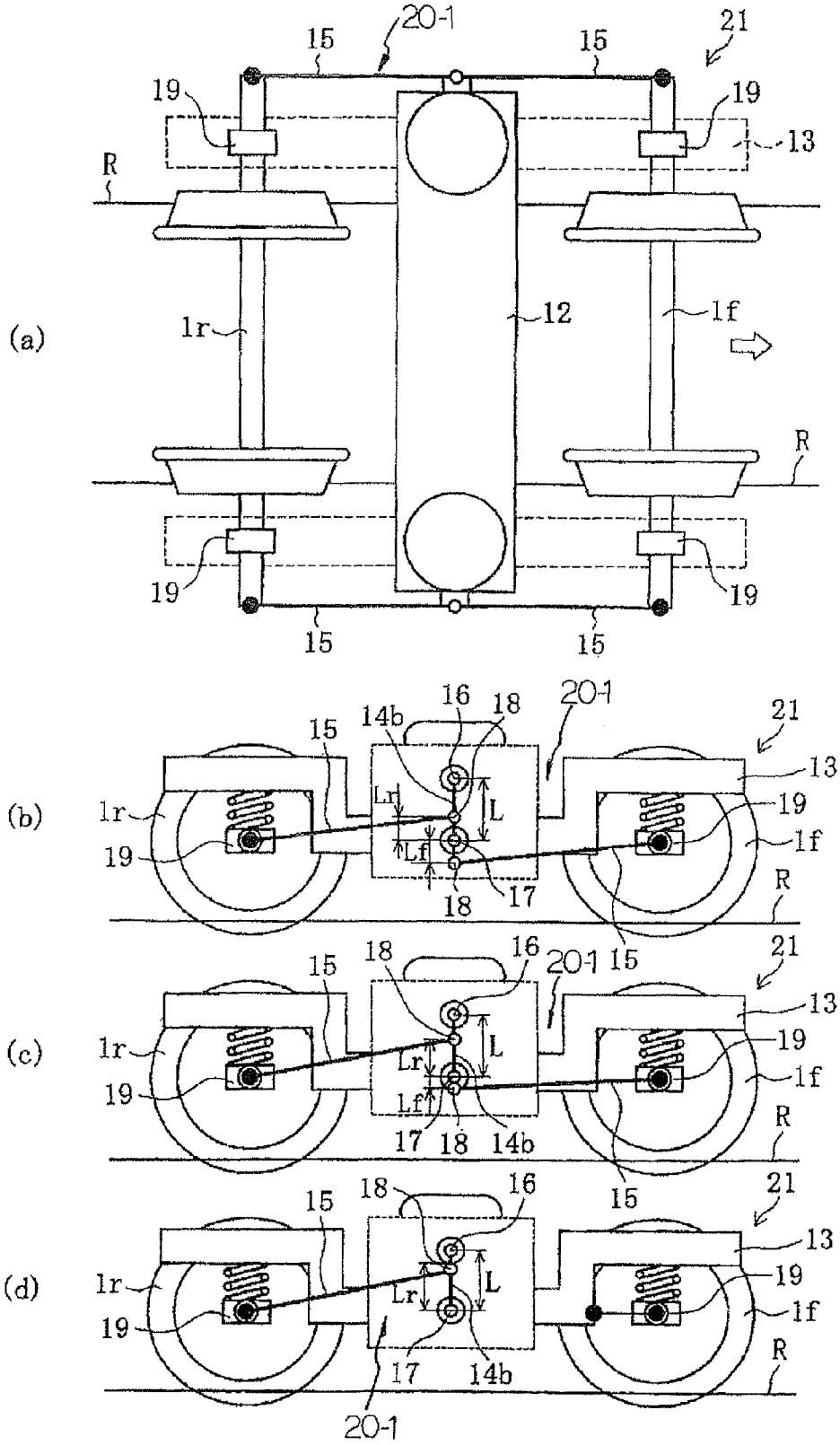
FIG. 3 is an explanatory view schematically showing the structure of a second example of a steerable truck according to the present invention (an example in which the lever ratios of steering levers vary), FIG. 3(*a*) being a plan view, and FIGS. 3(*b*)-3(*d*) being side views, FIG. 3(*b*) showing the case in which the lever ratios of a steering levers are the same, FIG. 3(*c*) showing the case in which the lever ratio of a steering lever is greater for the rear wheelset, and FIG. 3(*d*) showing the case in which only the rear wheelset is steered.
Figure 4:
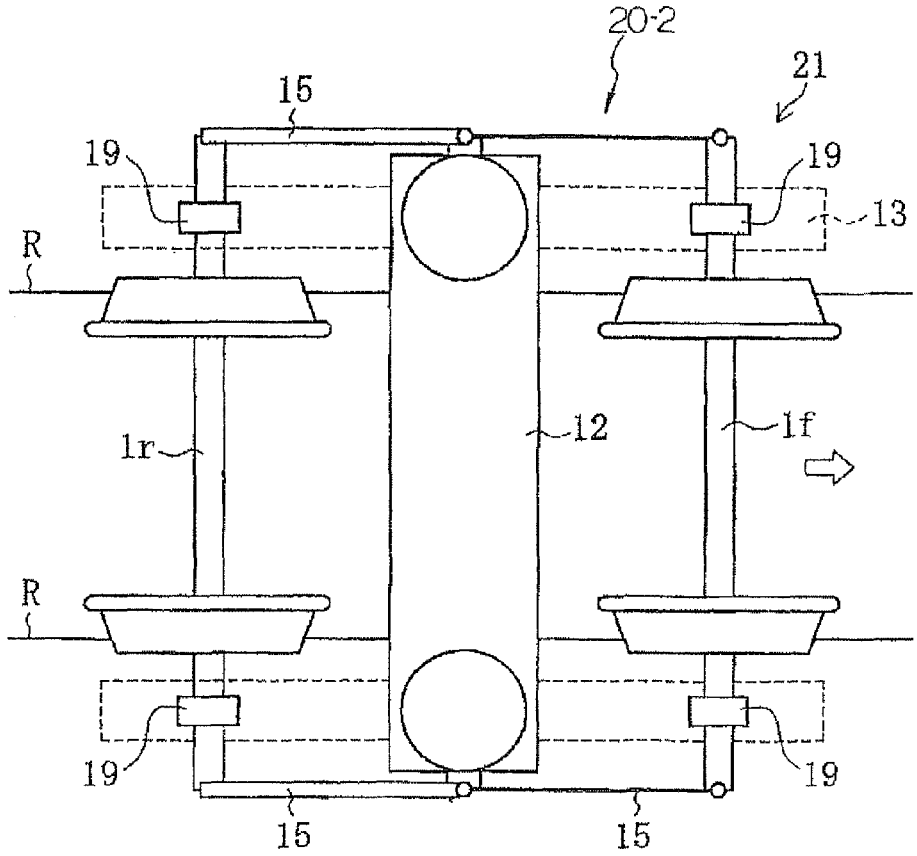
FIG. 4 is an explanatory view schematically showing the structure of a third example of a steerable truck according to the present invention (an example in which the stiffness of the steering links is varied), FIG. 4(*a*) being a plan view and FIG. 4(*b*) being a side view.
Figure 4:
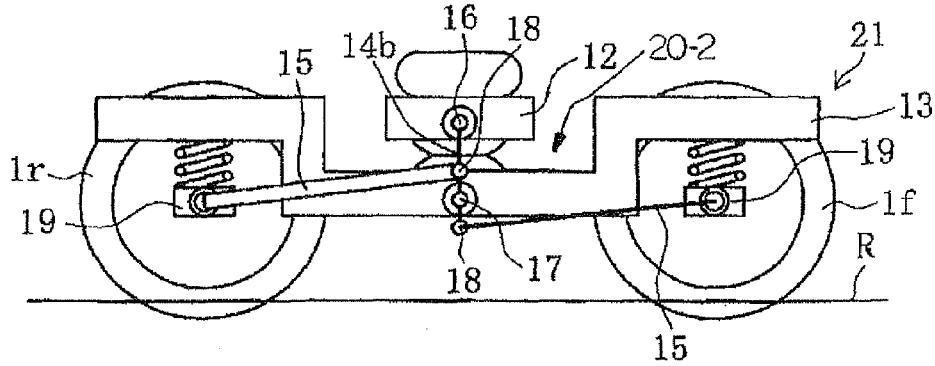
Figure 5:
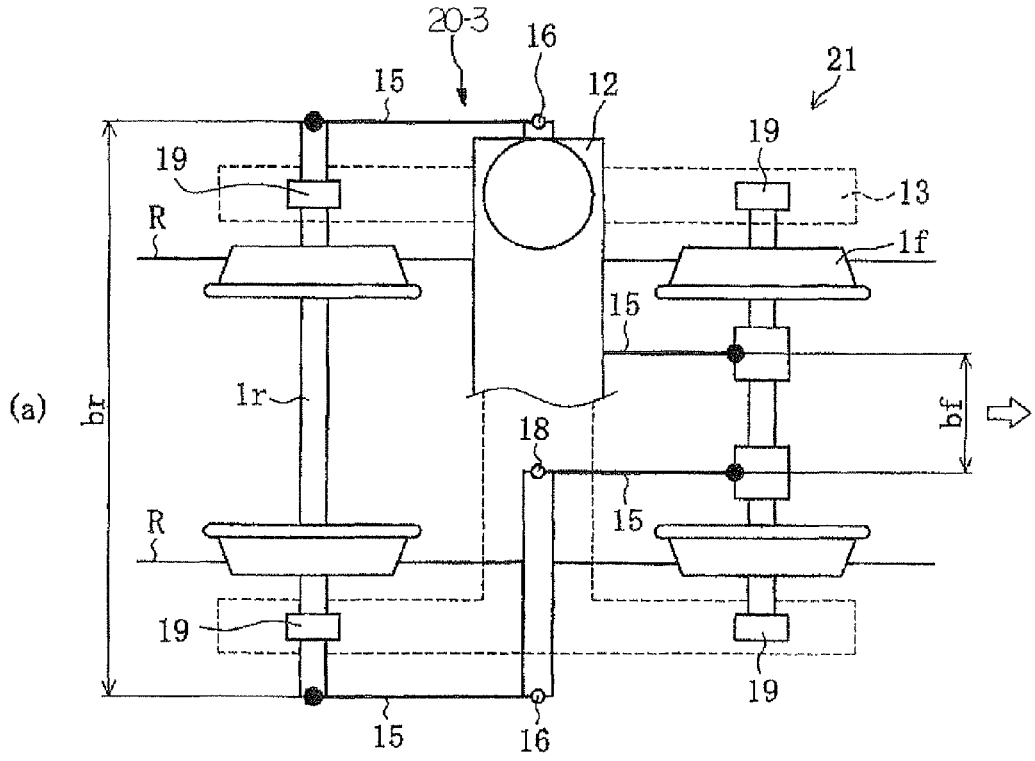
FIG. 5 is an explanatory view schematically showing the structure of a fourth example of a steerable truck according to the present invention (an example in which the location of the points where the steering links apply a force is varied), FIG. 5(*a*) being a plan view and FIG. 5(*b*) being a side view.
Figure 5:
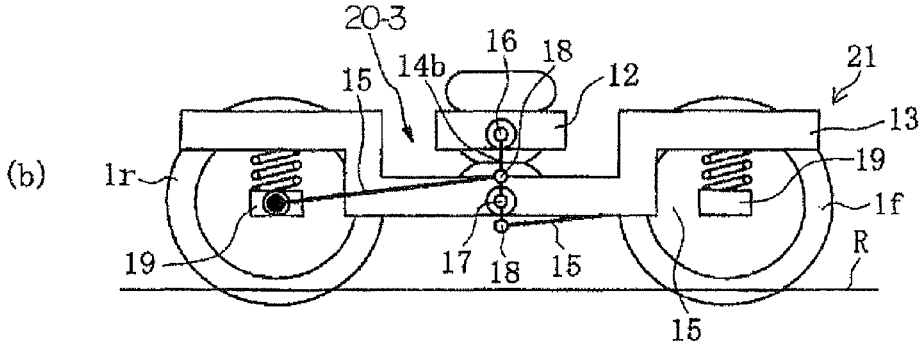

As shown in FIGS. 3-5, a truck 21 which steers both the front wheelset 1*f* and the rear wheelset 1*r* can be similarly employed as long as the steering angle $\alpha 2$ of the rear wheelset 1*r* is made larger than the steering angle $\alpha 1$ of the front wheelset 1*f*.

FIG. 3 is an explanatory view schematically showing the structure of a second example of a steerable truck 21 according to the present invention (an example in which the lever ratios of the steering levers are varied), FIG. 3(*a*) being a plan view, and FIGS. 3(*b*)-3(*d*) being side views. FIG. 3(*b*) shows the case in which the lever ratios of the steering levers are the same, FIG. 3(*c*) shows the case in which the lever ratios for the steering levers are larger for the rear wheelset, and FIG. 3(*d*) shows the case in which only the rear wheelset is steered.

In the truck frame steering unit 20-1 shown in FIG. 3, the horizontal first links 14*a* and 14*b* of the link-type truck frame steering unit 20 shown in FIG. 1 are replaced by vertically disposed steering levers 14*b*. The steering angle $\alpha 2$ of the rear wheelset 1*r* is made larger than the steering angle $\alpha 1$ of the front wheelset 1*f* by making the lever ratios of the steering levers 14*b* different for the front wheelset 1*f* and the rear wheelset 1*r*.

In this case, the lever ratios of the steering levers 14*b* for the front wheelset 1*f* and the rear wheelset 1*r* do not satisfy Lr=Lf as shown in FIG. 3(*b*), but rather the lever ratios of the steering levers 14*b* for the front wheelset 1*f* and the rear wheelset 1*r* are made to satisfy Lr>Lf as shown in FIG. 3(*c*), whereby the steering angle α2 of the rear wheelset 1*r* can be made larger. In this truck frame steering unit 20-1 as well, the structure may be made such that only the rear wheelset 1*r* is steered (Lf=0) as shown in FIG. 3(*d*).

In this manner, by making the steering angle α2 of the rear wheelset 1*r* larger than the steering angle α1 of the front wheelset 1*f*, the force acting upon the rear wheelset 1*r* is made different from the force acting on the front wheelset 1*f*, so a force acts on connection points 17 on the truck frame side. Accordingly, the present invention can also be accomplished by the structure shown in FIGS. 3(*c*) and 3(*d*).

FIG. 4 is an explanatory view schematically showing the structure of a third example of a steerable truck according to the present invention (an example in which the stiffness of the steering links is varied), FIG. 4(*a*) being a plan view and FIG. 4(*b*) being a side view.

In order to make the steering angle α1 of the front wheelset 1*f* different from the steering angle α2 of the rear wheelset 1*r*, the truck frame steering unit 20-2 shown in FIG. 4 varies the stiffness of the second links 15 for the front wheelset 1*f* and the rear wheelset 1*r* instead of by varying the lever ratios of the steering levers 14*b* for the front wheelset 1*f* and the rear wheelset 1*r* as shown in FIG. 3.

By making the stiffness of the rear wheelset 1*r* higher than the stiffness of the front wheelset 1*f*, the balance of the forces acting on the connection points 17 on the truck frame side is upset, forces are generated at the connection points 17, and the truck frame 13 is steered by the forces acting at the connection points 17.

FIG. 5 is an explanatory view schematically showing the structure of a fourth example of a steerable truck according to the present invention (an example in which the positions of the points where the steering links apply a force is varied), FIG. 5(*a*) being a plan view and FIG. 5(*b*) being a side view.

The truck frame steering unit 20-3 shown in FIG. 5 varies the points where forces are applied for steering the rear wheelset 1*r* and the front wheelset 1*f* so as to vary the steering angle α1 of the front wheelset 1*f* and the steering angle α2 of rear wheelset 1*r* instead of by varying the lever ratios of the steering levers 14*b* as shown in FIG. 3 or varying the stiffness of the second links 15 as shown in FIG. 4.

If the positions of the steering links 14*b* for the front wheelset 1*f* are inwards in the widthwise direction of a car from the positions of the steering links 14*b* for the rear wheelset 1*r*, even if the lever ratios are the same, if the distances bf, br of the positions where forces act on the front wheelset 1*f* and the rear wheelset 1*r* satisfy br>bf, the balance of the forces acting on the connection points 17 on the truck frame side is upset. As a result, the truck frame 13 can be steered.

Next, a situation in which a steerable truck 21 according to the present invention is mounted on a railway car 31 will be explained.

Figure 6:
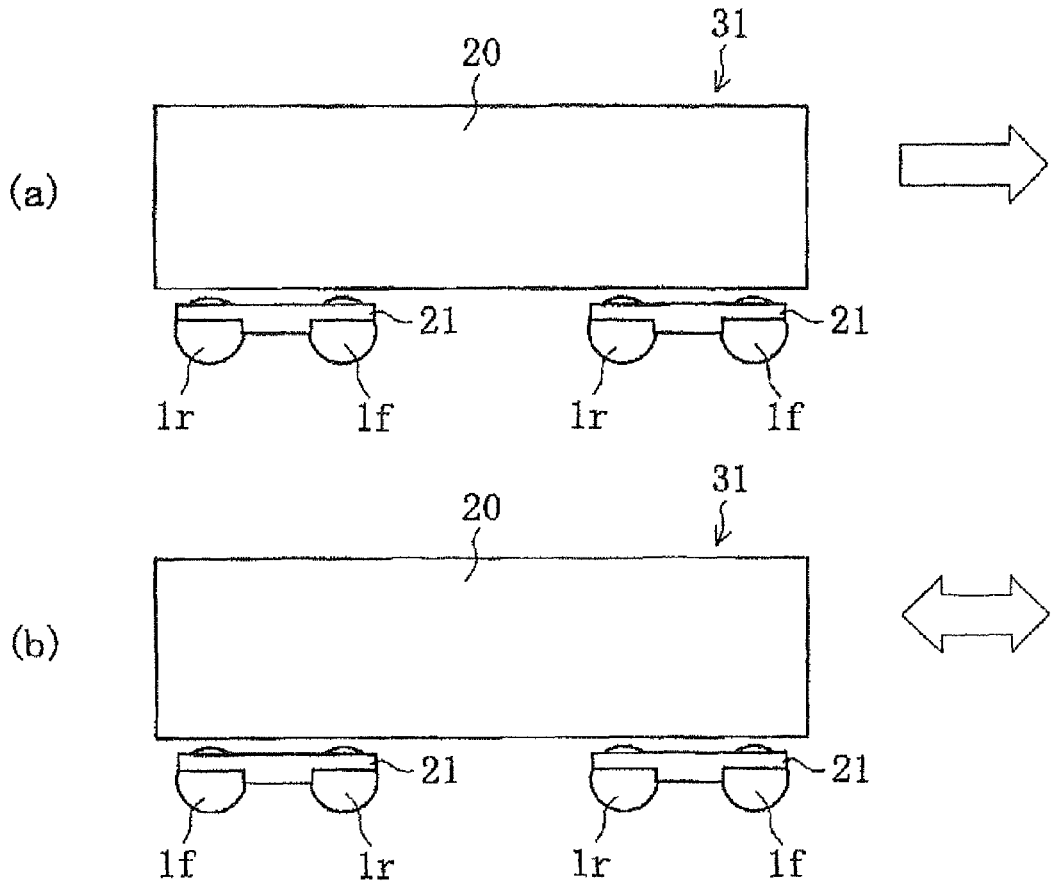
FIGS. 6(*a*) and 6(*b*) are explanatory views showing an example of applying a steerable truck according to the present invention to a car with 2-axle bogie trucks.

FIGS. 6(*a*) and 6(*b*) are explanatory views showing an example in which a steerable truck according to the present invention is applied to a car with 2-axle bogie trucks.

The basic arrangement is such that the steering angle for the rear wheelset 1*r* of each steerable truck 21 is larger for the steerable trucks 21 mounted both on the front side and on the rear side in the direction of travel in FIG. 6(*a*).

However, the direction of travel of the railway car 31 reverses. Therefore, as shown in FIG. 6(*b*), the arrangement of the steerable truck 21 positioned on the rear side in the direction of travel in FIG. 6(*a*) may be the opposite of the arrangement of the steerable truck 21 positioned on the front side in the direction of travel. This is because the wheelset having the highest lateral pressure in the railway car 31 is the front wheelset 1*f* of the steerable truck 21 on the front side in the direction of travel, and the lateral pressure of the front wheelset of the steerable truck 21 on the rear side in the direction of travel is smaller. For the same reason, the structure may be such that only the truck on the front side in the direction of travel is made a steerable truck 21 according to the present invention.

Figure 7:
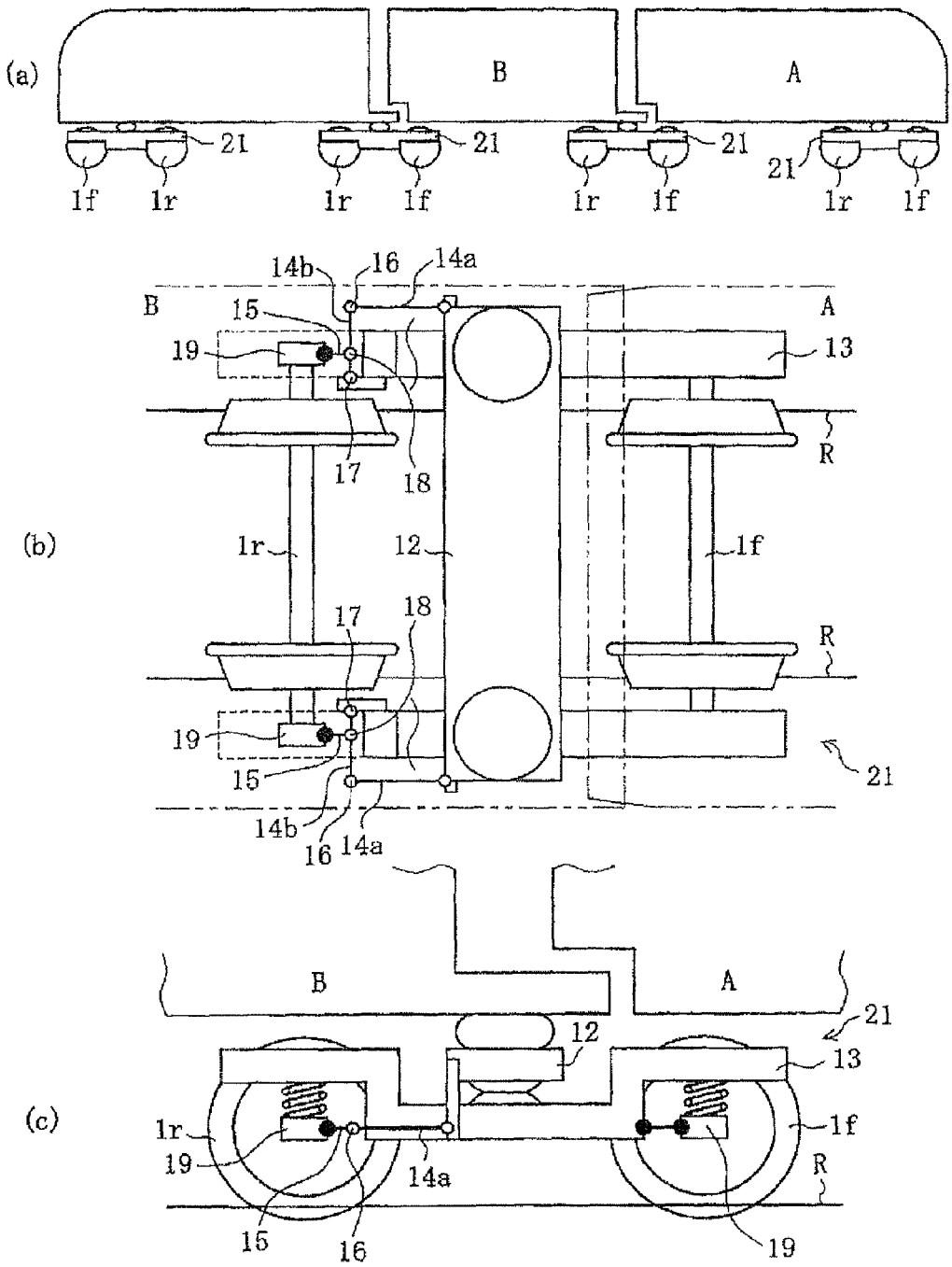
FIG. 7 is an explanatory view showing an example of applying a steerable truck according to the present invention to articulated cars with 2-axle bogie trucks, FIG. 7(*a*) being an explanatory view schematically showing the entire cars, FIG. 7(*b*) being a plan view of an articulated portion, and FIG. 7(*c*) being a side view of the articulated portion.

FIG. 7 is an explanatory view showing an example in which a steerable truck according to the present invention is applied to articulated cars with 2-axle trucks. FIG. 7(*a*) is an explanatory view schematically showing the entire car, FIG. 7(*b*) is a plan view of an articulated portion, and FIG. 7(*c*) is a side view of the articulated portion.

In the case shown in FIG. 7(*a*) in which car A is mounted on car B to form articulated cars, a steerable truck 21 according to the present invention can be used as the trucks for car B. In this case, the same effect as for the case shown in FIG. 6(*b*) is obtained regardless of the direction of travel. In the case of the articulated car shown in FIG. 7, the trucks installed in locations other than where two car bodies are connected also use a steerable truck 21 according to the present invention, but a conventional truck can be used in portions other than the articulated portions.

The steerable truck 21 according to the present invention shown in FIG. 1 was mounted as shown in FIG. 6(*a*) on a typical commuter train, a test run was carried out at a speed of 15 km/hour on a curved region with a radius of curvature R of 120 m (cant of 60 mm), and the outer track lateral pressure generated in the front wheelset 1*f* and the longitudinal creep force generated in the rear wheelset 1*r* were measured. The results of measurement are shown in the following Table 2 and in the graphs of FIGS. 8 and 9.

TABLE 2

| | Conventional truck | Steerable truck of present invention | Comments |
|---|---|---|---|
| Outer rail lateral pressure produced in front wheelset [kN] | 11 | 4 | |
| Longitudinal creep forces produced in rear wheelset [kN] | −7.4 | 3.7 | +value: acting as SM |

Figure 8:
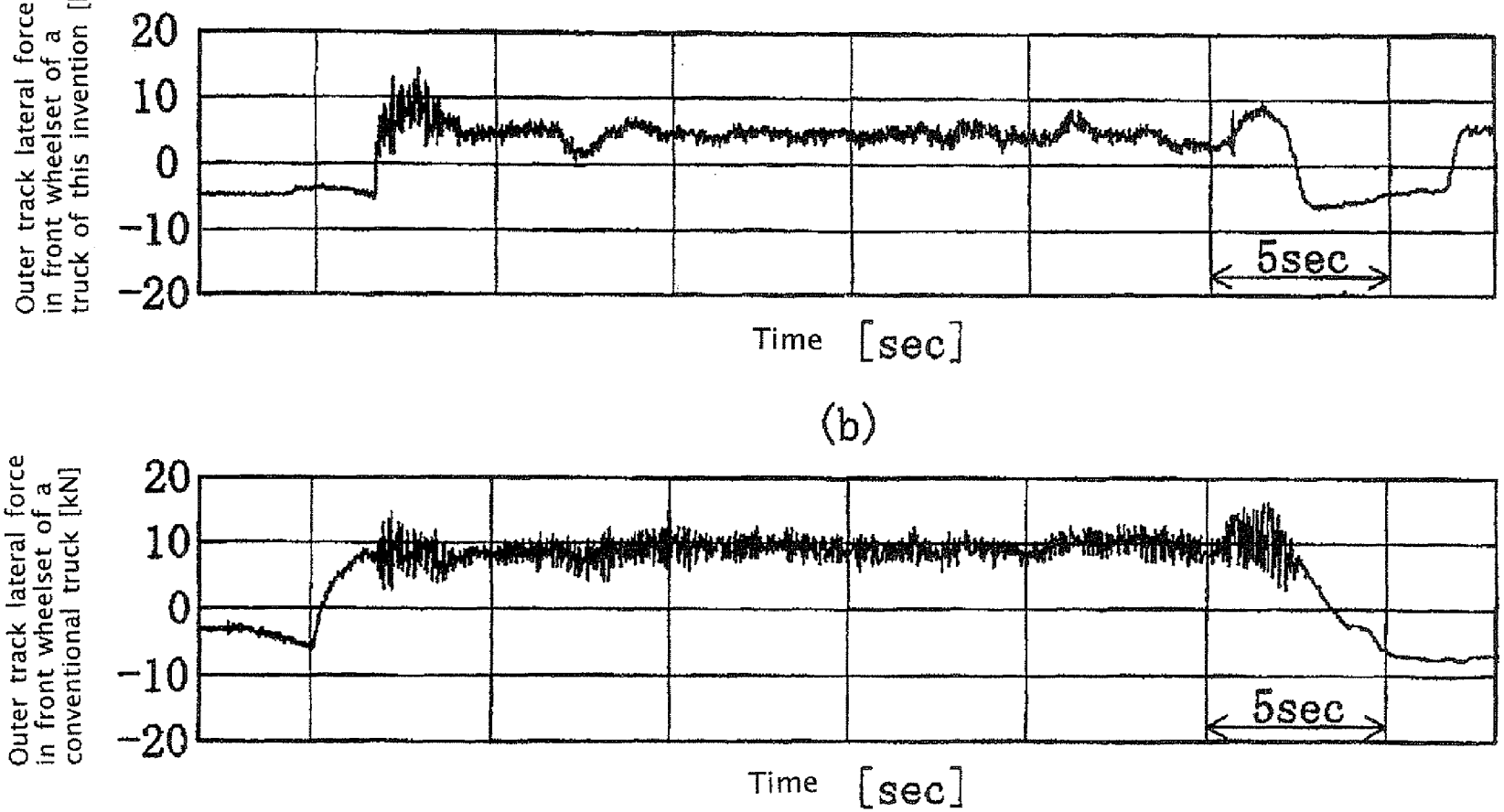
FIG. 8 gives graphs showing the results of an investigation of the lateral force in the outer track which develops in the front wheelset when a car is traveling along a curved track, FIG. 8(*a*) showing the case using a steerable truck according to the present invention, and FIG. 8(*b*) showing the case using a conventional truck.
Figure 9:
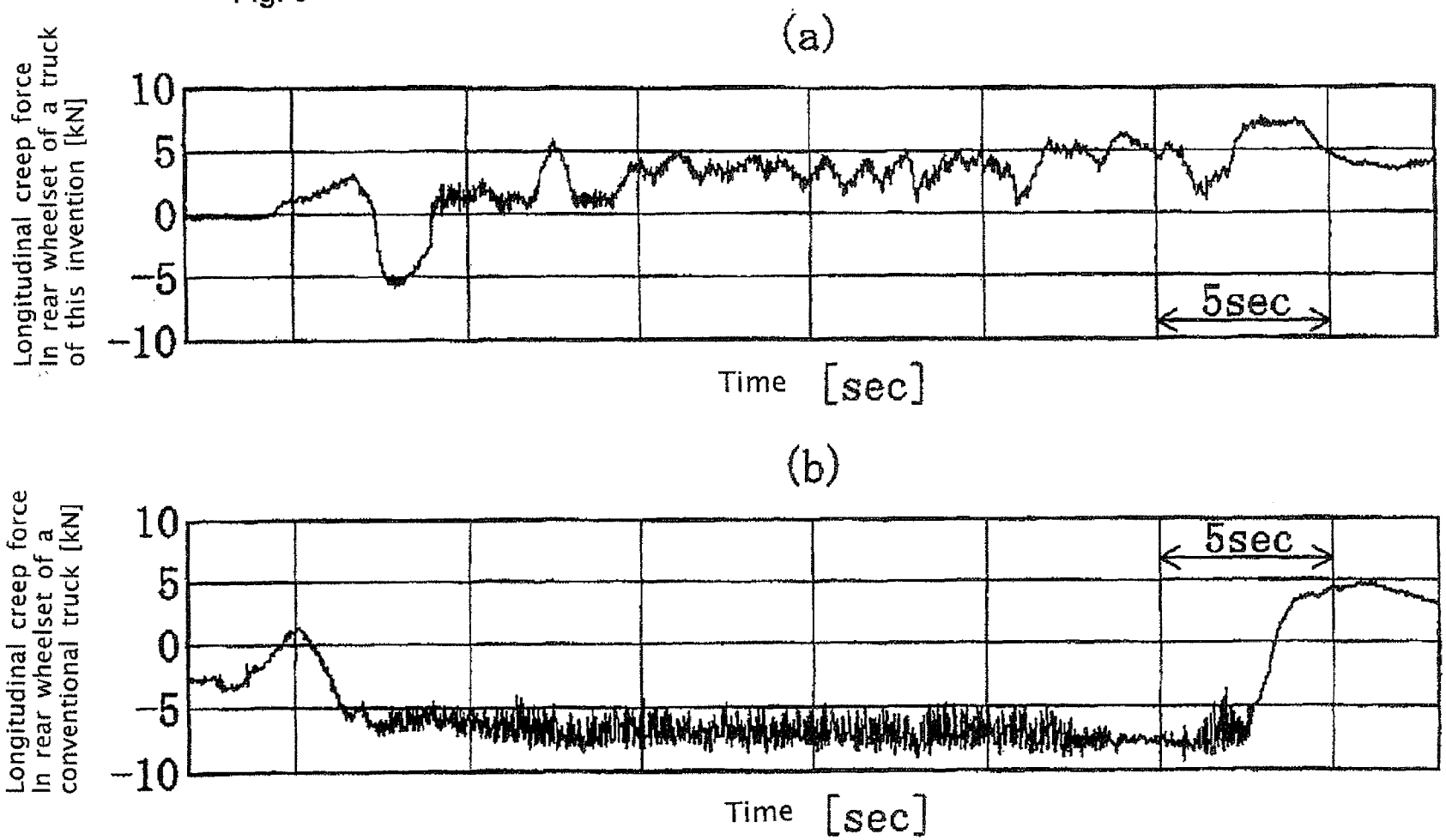
FIG. 9 gives graphs showing the results of an investigation of the longitudinal creep force which develops in the rear wheelset when a car is traveling along a curved track, FIG. 9(*a*) showing the case using a steerable truck according to the present invention and FIG. 9(*b*) showing the case using a conventional truck.

From the results shown in FIG. 8 and Table 2, it can be seen that the outer track lateral pressure which develops in the front wheelset 1*f* of a steerable truck 21 according to the present invention is smaller than the outer track lateral pressure which develops in the front wheelset of a conventional truck. In addition, it can be seen as shown in FIG. 9(*a*) that in a steerable truck 21 according to the present invention, the longitudinal creep forces which develop in the rear wheelset 1*r* switch from the directions producing an ASM to the directions producing a SM to achieve the desired steering.

A steerable truck according to the present invention exhibits the behavior shown in FIG. 2 when traveling along a curved track. Due to the rear wheelset moving towards the outer track side, a rolling radius difference develops, and longitudinal creep forces act in the opposite directions from in a conventional truck. Due to the "steering levers", this yawing moment in the clockwise direction acts on the truck frame as a yawing moment in the clockwise direction.

At this time, as shown in Table 1, the fulcrums of the "steering levers" are on the car body side, the points of effort are on the wheelset side, and the points of load are on the truck frame side. Therefore, due to the yawing moment acting on the truck frame, the yawing angle of the truck frame decreases. Due to the yawing angle of the truck frame decreasing, the attack angle of the front wheelset also decreases, and the inner track lateral pressure and the outer track lateral pressure both decrease.

In the above description, examples of carrying out the present invention have been explained, but the present invention is not limited to these examples, and suitable variations are of course possible as long as they fall within the technical concept set forth by the claims.

Figure 10:
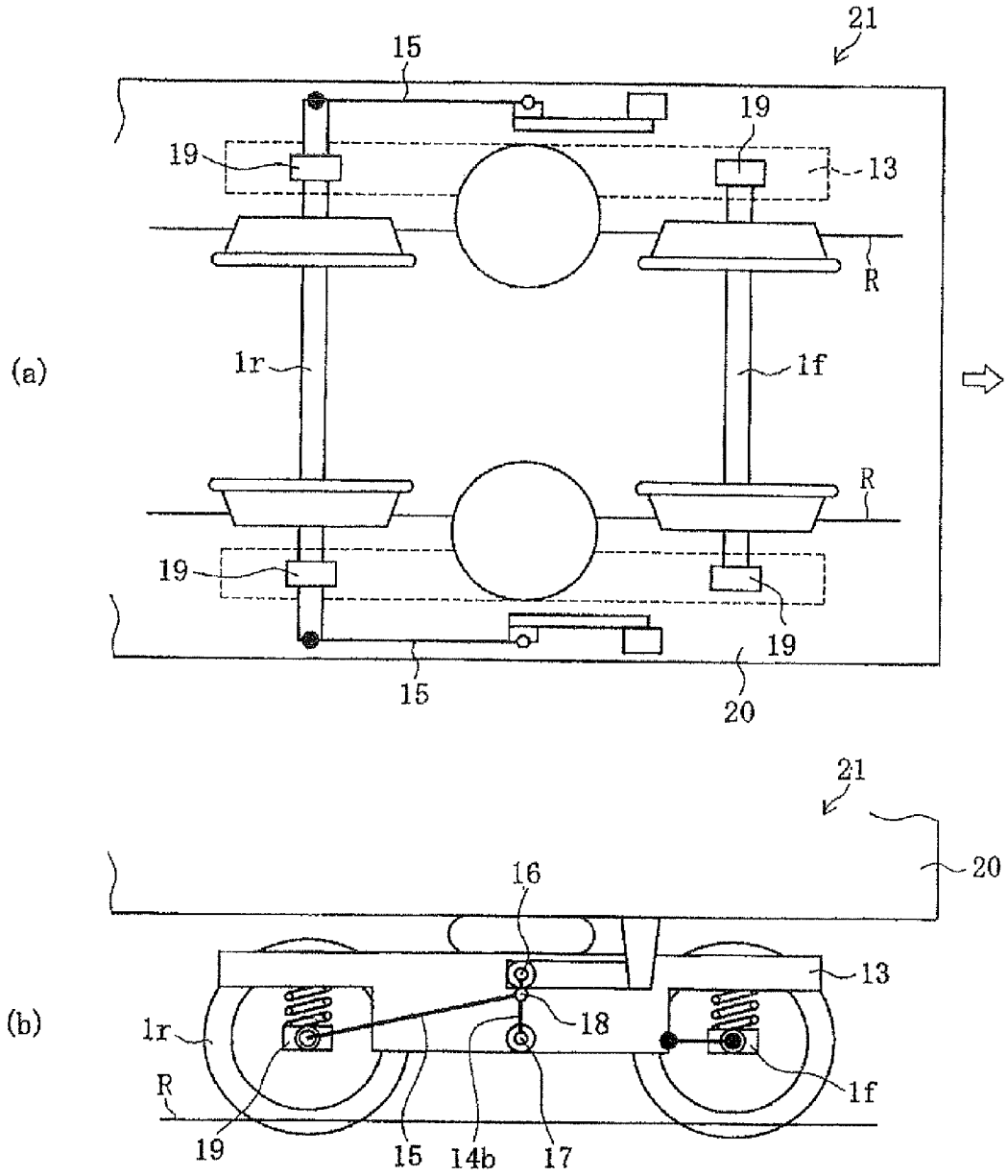
FIG. 10 is an explanatory view showing an example of applying a steerable truck according to the present invention to a bolsterless truck, FIG. 10(*a*) being a plan view and FIG. 10(*b*) being a side view.

FIG. 10 is an explanatory view showing an example of applying a steerable truck according to the present invention to a bolsterless truck, FIG. 10(*a*) being a plan view and FIG. 10(*b*) being a side view.

FIGS. 1-5 explain examples in which the present invention is applied to a bolster-type truck, but since it is sufficient that the bogie angle as an input corresponds to a relative displacement of a car and a truck, the present invention may also be applied to a bolsterless truck as shown in FIG. 10. Reference number 20 in FIG. 10 indicates a car body.

Figure 11:
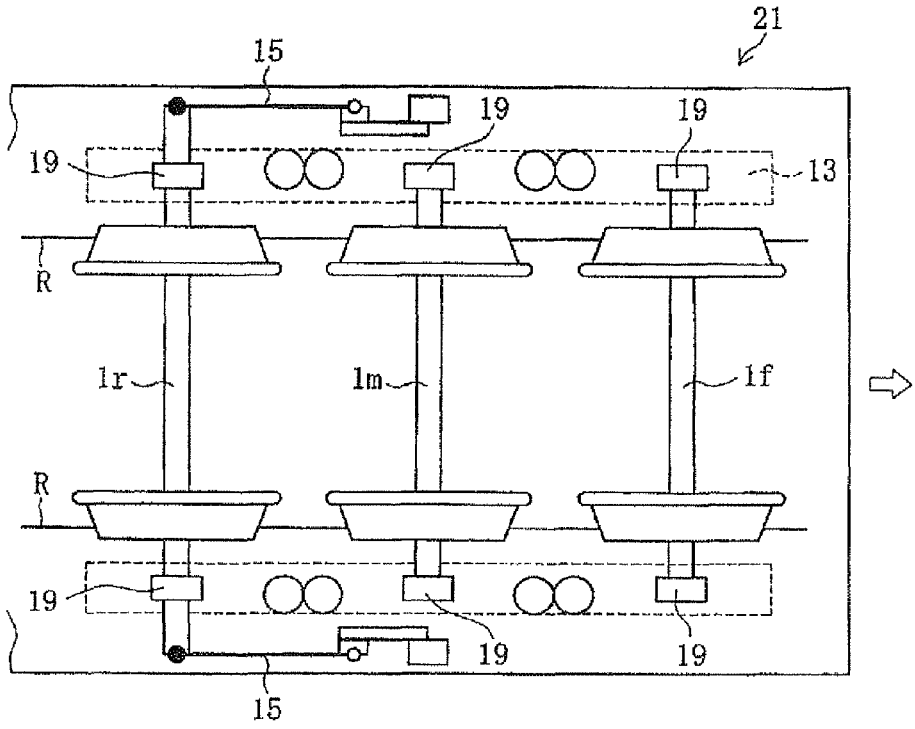
FIG. 11 is an explanatory view showing an example of applying a steerable truck according to the present invention to a 3-axle bogie truck, FIG. 11(*a*) being a plan view and FIG. 11(*b*) being a side view.
Figure 11:
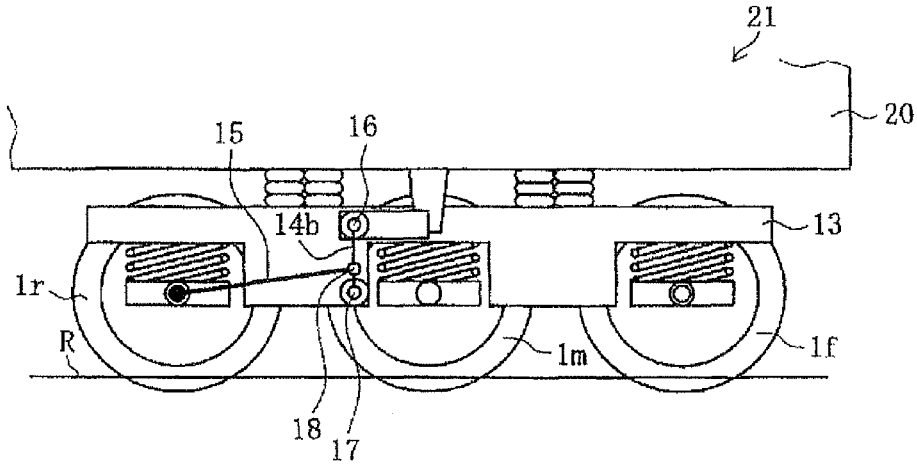

FIG. 11 is an explanatory view showing an example in which a steerable truck according to the present invention is applied to a 3-axle bogie truck. FIG. 11(*a*) is a plan view and FIG. 11(*b*) is a side view.

FIGS. 1-10 show examples in which a steerable truck 21 according to the present invention is applied to a 2-axle truck. In the case shown in FIG. 11 in which a steerable truck 21 according to the present invention is applied to a 3-axle bogie truck, the steering angle of the rear wheelset 1*r* is made larger in the same manner as for a 2-axle truck. Symbol 1*m* in FIG. 11 indicates the middle wheelset.

Figure 12:
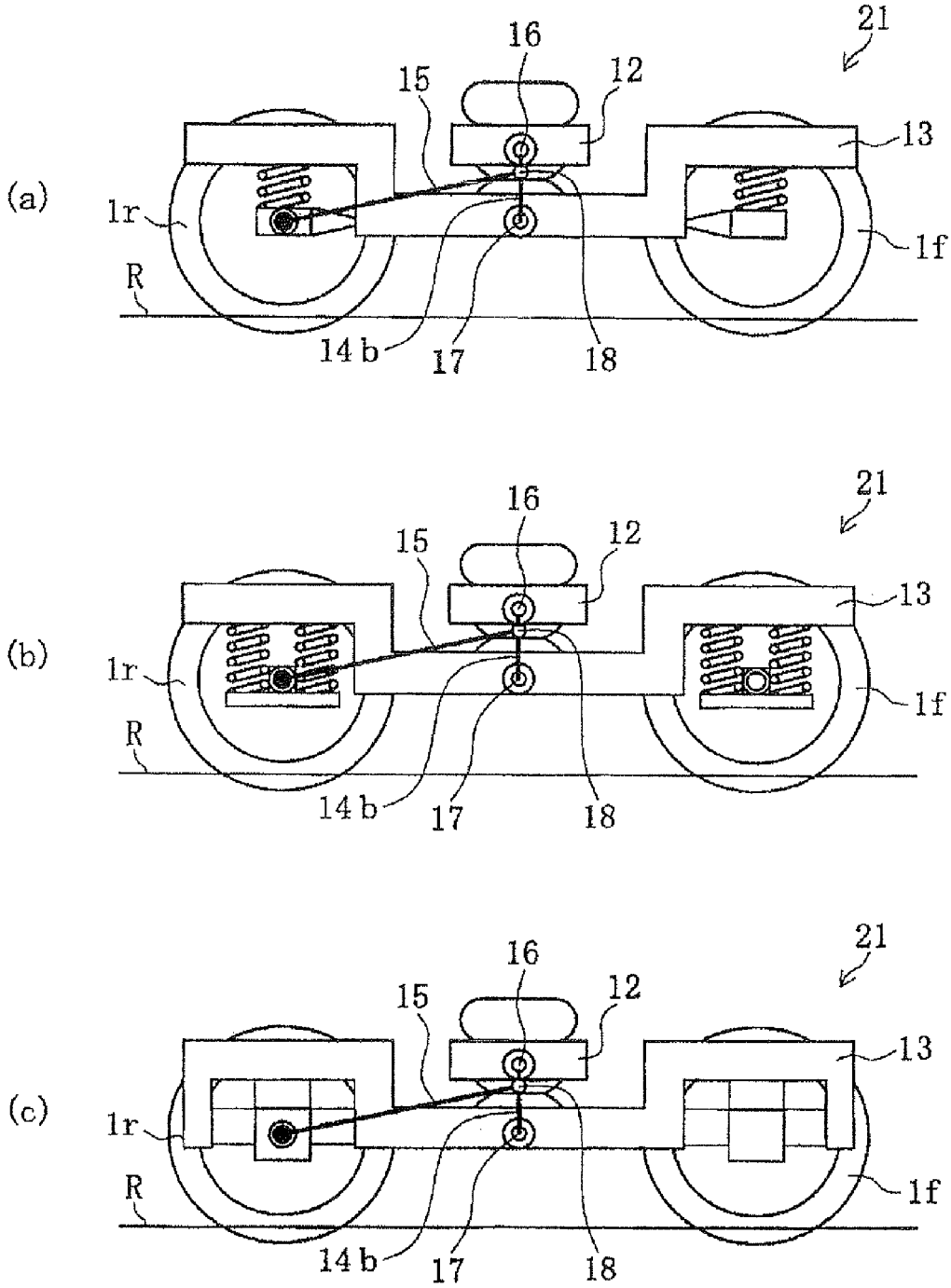
FIG. 12 is an explanatory view showing various types of axle box suspensions which can be used in a steerable truck according to the present invention, FIG. 12(*a*) showing a guide arm-type axle box suspension, FIG. 12(*b*) showing a wing-type axle box suspension, and FIG. 12(*c*) showing a shock absorbing rubber-type axle box suspension.
Figure 13:
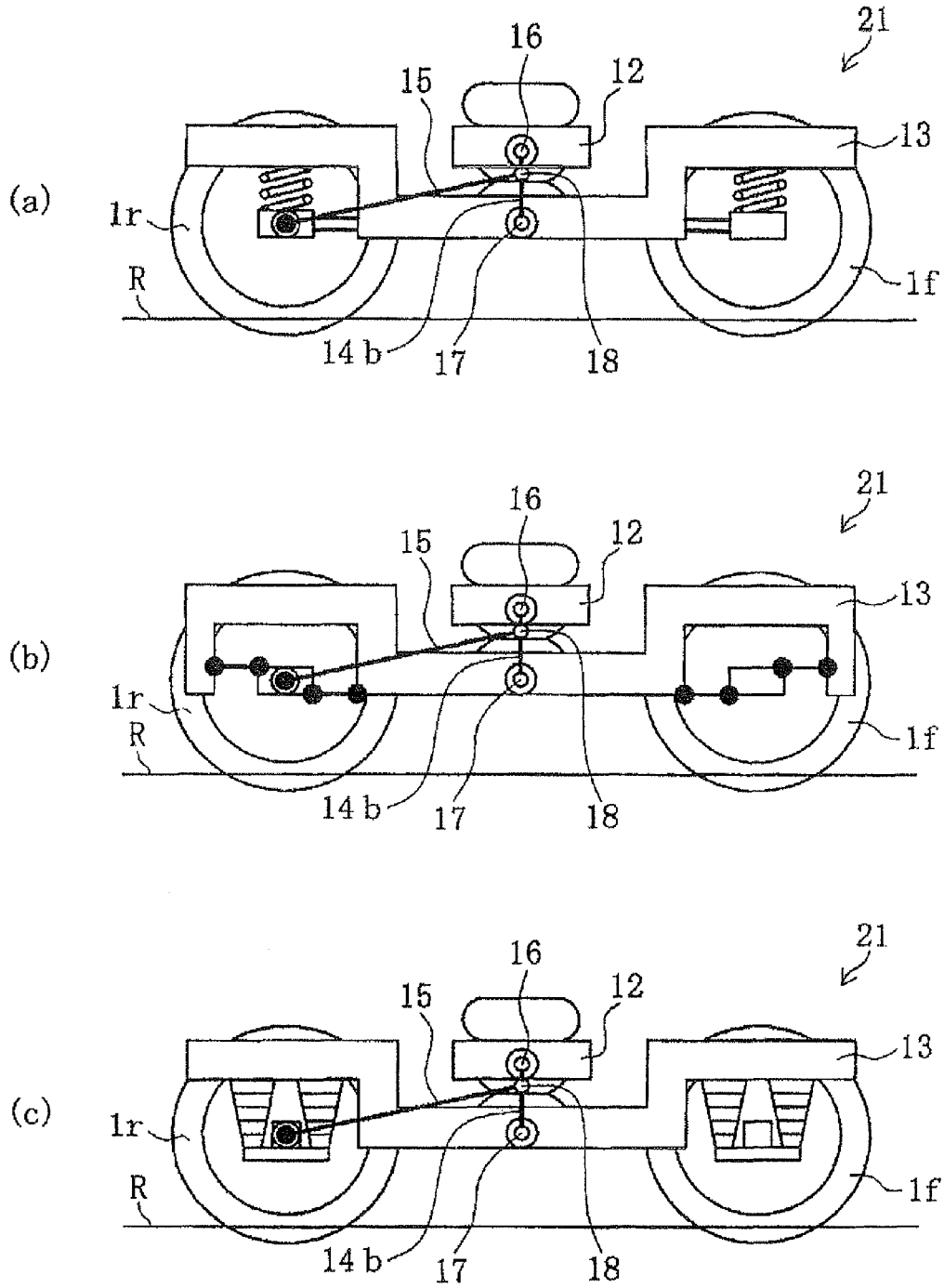
FIG. 13 is an explanatory view showing various types of axle box suspensions which can be used in a steerable truck according to the present invention, FIG. 13(*a*) showing a leaf spring-type axle box suspension, FIG. 13(*b*) showing an Alstom-type axle box suspension, and FIG. 13(*c*) showing a multi-layered conic rubber-type axle box suspension.

FIGS. 12 and 13 are explanatory views showing various types of axle box suspensions which can be used in a steerable truck according to the present invention. FIG. 12(*a*) shows a guide arm-type axle box suspension, FIG. 12(*b*) shows a wing-type axle box suspension, FIG. 12(*c*) shows a shock absorbing rubber-type axle box suspension, FIG. 13(*a*) shows leaf spring-type axle box suspension, FIG. 13(*b*) shows an Alstom-type axle box suspension, and FIG. 13(*c*) shows a multi-layered conic rubber-type axle box suspension.

An axle box suspension used in a steerable truck according to the present invention is not limited to the monolink type as in the examples of FIGS. 1, 2, 7, and 10 and it is also possible to use various axle box suspensions like those shown in FIGS. 12 and 13.

The invention claimed is:

1. A steerable truck for a railway car having a truck frame which rotatably supports a front wheelset positioned on a front side of the truck frame in a direction of travel and a rear wheelset positioned on a rear side in the direction of travel through axle boxes, and a truck frame steering unit for controlling the steering angle of at least the rear wheelset when traveling along a curved track in the direction of travel, characterized in that when the truck is traveling along a curved track, the truck frame is steered so as to be aligned with the tangential direction of the curved track by controlling the steering angle of the rear wheelset by the truck frame steering unit so that the steering angle of the rear wheelset is larger than the steering angle of the front wheelset wherein control of the steering angle of the rear wheelset by the truck frame steering unit is carried out by a link mechanism mounted on the truck frame, the link mechanism further comprising:

(1) a pair of first links; (2) a pair of steering levers, each of which connects the car body and the truck frame; (3) and a pair of second links, each of which connects the steering lever and an axle box that rotatably supports the rear wheelset, and first connection points, each of which connecting the first link and the steering lever of pairs (1) and (2) and being used as a fulcrum, second connection points, each of which connecting the steering lever and the second link of pairs (2) and (3) and being used as a point of effort, and third connection points, each of which connecting to the truck frame and being used as a point of load, so that the truck frame is steered such that the steering angle of the rear wheelset is larger than the steering angle of the front wheelset.

2. A steerable truck for a railway car as set forth in claim 1 wherein the link mechanism controls the steering angle in accordance with a bogie angle which is a relative displacement of the truck frame with respect to the car body during travel along a curved track.

3. A steerable truck for a railway car as set forth in claim 1 wherein the stiffness of a link connected to the rear wheelset is different from the stiffness of a link connected to the front wheelset.

4. A railway car having a truck on the front side and a truck on the rear side in the direction of travel, characterized in that at least one of the trucks on the front side and on the rear side in the direction of travel is a steerable truck for a railway car as set forth in claim 1.

5. A railway car characterized by having a steerable truck for a railway car as set forth in claim 1 on a front side and on a rear side of the railway car in the direction of travel, wherein the rear wheelset of each steerable truck on the railway car face each other.

6. Articulated cars characterized by having a steerable truck for a railway car as set forth in claim 1 at least in the articulated portion between two car bodies.

7. A steerable truck for a railway car having a truck frame which rotatably supports a front wheelset positioned on a front side of the truck frame in the direction of travel and a rear wheelset positioned on a rear side of the truck frame in the direction of travel through axle boxes, and a truck frame steering unit for controlling the steering angle of at least the rear wheelset when traveling along a curved track in the direction of travel, characterized in that when the truck is traveling along a curved track in the direction of travel, the yawing angle of the truck frame, which is the angle formed in a horizontal plane between the radial direction of the curved track and the centerline in the fore and aft direction of the truck frame, is decreased by controlling the steering angle of the rear wheelset by the truck frame steering unit so that the steering angle of the rear wheelset is larger than the steering angle of the front wheelset, wherein control of the steering angle of the rear wheelset by the truck frame steering unit is carried out by a link mechanism mounted on the truck frame, the link mechanism further comprising:

(1) a pair of first links; (2) a pair of steering levers, each of which connects the car body and the truck frame; (3) and a pair of second links, each of which connects the steering lever and an axle box that rotatably supports the rear wheelset, and first connection points, each of which connecting the first link and the steering lever of pairs (1) and (2) and being used as a fulcrum, second connection points, each of which connecting the steering lever and the second link of pairs (2) and (3) and being used as a point of effort, and third connection points, each of which connecting to the truck frame and being used as a point of load, so that the truck frame is steered such that the steering angle of the rear wheelset is larger than the steering angle of the front wheelset.

8. The steerable truck for a railway car as set forth in claim 7, wherein the link mechanism controls the steering angle in accordance with a bogie angle which is a relative displacement of the truck frame with respect to the car body during travel along a curved track.

9. The steerable truck for a railway car as set forth in claim 7, wherein the stiffness of a link connected to the rear wheelset is different from the stiffness of a link connected to the front wheelset.

10. The railway car having a truck on the front side and a truck on the rear side in the direction of travel, characterized in that at least one of the trucks on the front side and on the rear side in the direction of travel is a steerable truck for a railway car as set forth in claim 7.

11. The railway car characterized by having a steerable truck for a railway car as set forth in claim 7 on a front side and on a rear side of the railway car in the direction of travel, wherein the rear wheelset of each steerable truck on the railway car face each other.

12. Articulated cars characterized by having a steerable truck for a railway car as set forth in claim 7 at least in the articulated portion between two car bodies.

* * * * *